United States Patent [19]

Wang et al.

[11] Patent Number: 5,040,713

[45] Date of Patent: Aug. 20, 1991

[54] LATERAL TEAR TAPE STAND

[75] Inventors: Chung-Ching Wang; Kuo C. Liao, both of Taipei, Taiwan

[73] Assignee: Seal King Industrial Co., Ltd., Taipei, Taiwan

[21] Appl. No.: 408,263

[22] Filed: Sep. 18, 1989

[51] Int. Cl.[5] ..... B26F 3/02; B65D 85/676

[52] U.S. Cl. ..... 225/16; 225/88

[58] Field of Search ..... 225/10-16, 225/77, 88

[56] References Cited

U.S. PATENT DOCUMENTS

| | | | |
|---|---|---|---|
| 1,959,332 | 5/1934 | Bowles et al. | 225/16 |
| 2,676,765 | 4/1954 | Kaplan | 225/16 |
| 3,054,528 | 9/1962 | Loomis | 225/16 |
| 3,329,326 | 7/1967 | Simon | 225/16 |

*Primary Examiner*—Hien H. Phan

*Attorney, Agent, or Firm*—Ezra Sutton

[57] ABSTRACT

A lateral tear tape stand comprises a base plate; a lower cover body closely disposed on the base plate and having a lateral opening and a longitudinal opening; a controlling member having one end movably fixed on the base plate and the other end outwardly extending through the longitudinal opening; a driving mechanism having a first member, a second member and a spring member for rotatably connecting one end of the first member and that of the second member, the other end of the first member rotatably disposed on the lower cover body and that of the second member outwardly extending through the lateral opening; a pushing mechanism having a laterally elongated pushing plate projecting from the first member and contacting with the controlling member, and a flexible member for connecting the laterally elongated pushing plate with the lower cover body; a hollow and cylindrical driven member irreversibly sheathed on the driving mechanism and having serrated inner wall for irreversably and removably engaging with the other end of the second member; and an upper cover having a vertical edge and a knife member inwardly removable disposed on the vertical edge of the cover such that the clearance between the knife member and the edge of the cover equals to the thickness of a lateral tear tape.

7 Claims, 4 Drawing Sheets

LATERAL TEAR TAPE STAND

BACKGROUND OF THE INVENTION

The present invention relates to a lateral tear tape stand and particularly to a novel structure of a lateral tear tape stand which can make the lateral tear tape to be torn horizontally and formed a regular size of films.

In the prior art, tapes are always manufactured as a continuous roller, and during use, they must be cut by a knife or a pair of scissors or a tape stand. Owing to such using manner, the tape must be brought and pull outwardly by man's fingers and it is therefore dirtied as well as deglued. Moreover, it is difficult to cut the tapes into the same size for regular use.

SUMMARY OF THE INVENTION

It is therefore a primary objective of the present invention to overcome the aforesaid disadvantages. A secondary objective of the present invention is to provide a lateral tear tape stand which can be easily and conveniently operated.

A further objective of the present invention is to provide a lateral tear tape stand which can provide several firms in standardized sizes.

According to the aforementioned objects, the lateral tear tape stand of this invention comprises a base plate; a lower cover body closely disposed on the base plate and having a lateral opening and a longitudinal opening; a controlling means having one end movably fixed on the base plate and the other end outwardly extending through the longitudinal opening; a driving means having a first member, a second member and a spring member for rotatably connecting one end of the first member and that of the second member, the other end of the first member rotatably disposed on the lower cover body and that of the second member outwardly extending through the lateral opening; a pushing means having a laterally elongated pushing plate projecting from the first member and contacting with the controlling means, and a flexible member for connecting the laterally elongated pushing plate with the lower cover body; a hollow and cylindrical driven means irreversibly sheathed on the driving means and having serrated inner wall for irreversibly and removably engaging with the other end of the second member; and an upper cover having a vertical edge and a knife member inwardly removable disposed on the vertical edge of the cover such that the clearance between the knife member and the edge of the cover equals to the thickness of a lateral tear tape.

Further objectives and advantages of the present invention will become apparent as the following description proceeds, and the features of novelty which characterize the invention will be pointed out with particularity in the claims annexed there to and forming a part of this invention.

DETAILED DESCRIPTION OF THE PRESENT EMBODIMENT

Figure 1:
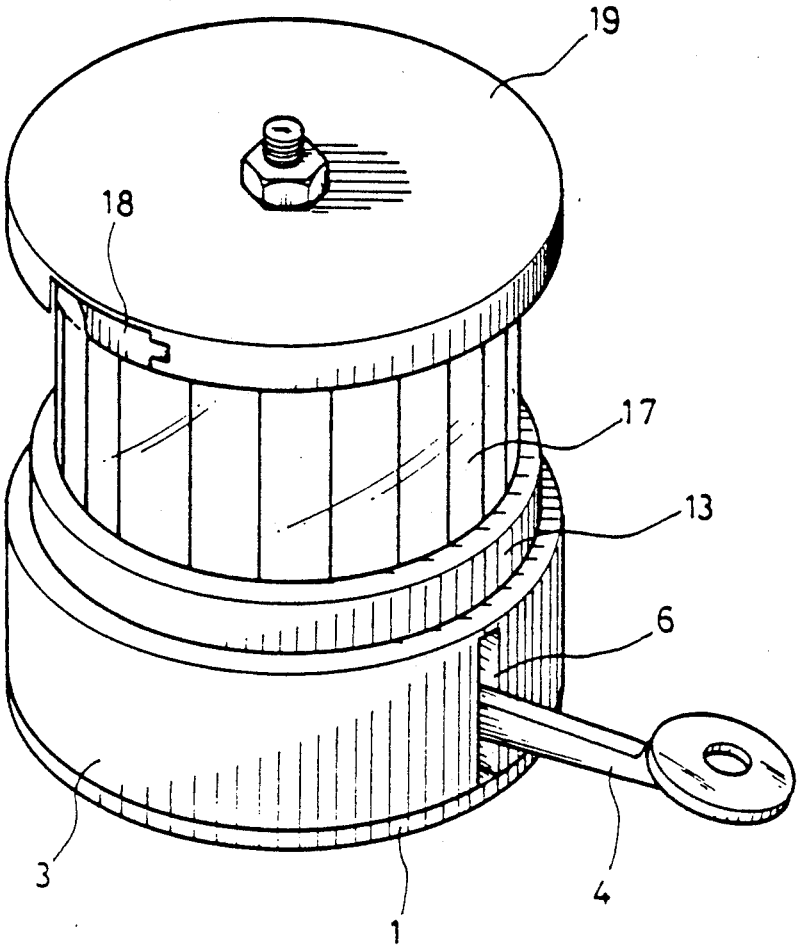
FIG. 1 is a perspective view of a lateral tear tape stand in accordance with the present invention.
Figure 2:
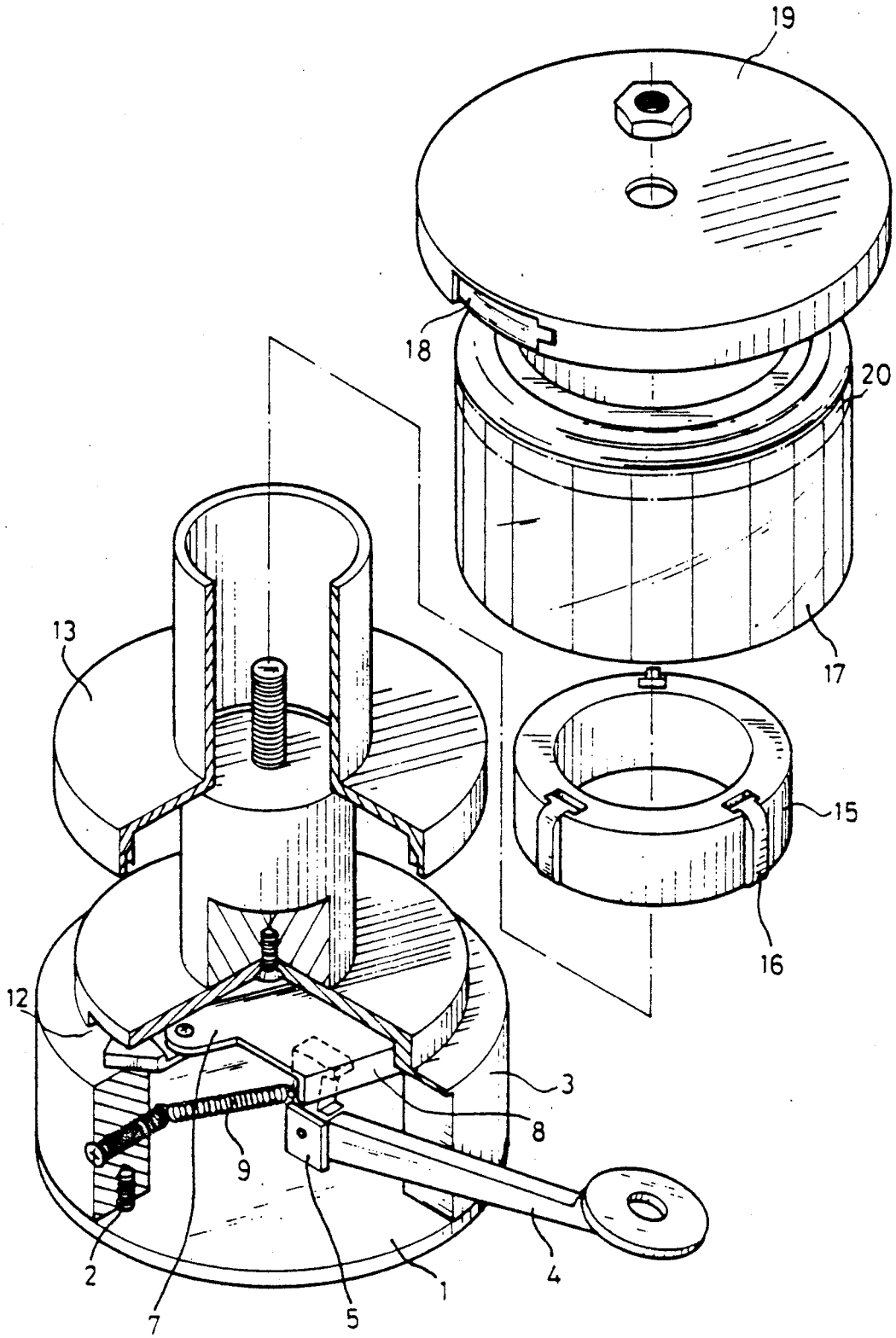
FIG. 2 is a partially cross-sectionally exploded view of FIG. 1 in accordance with the present invention.
Figure 3:
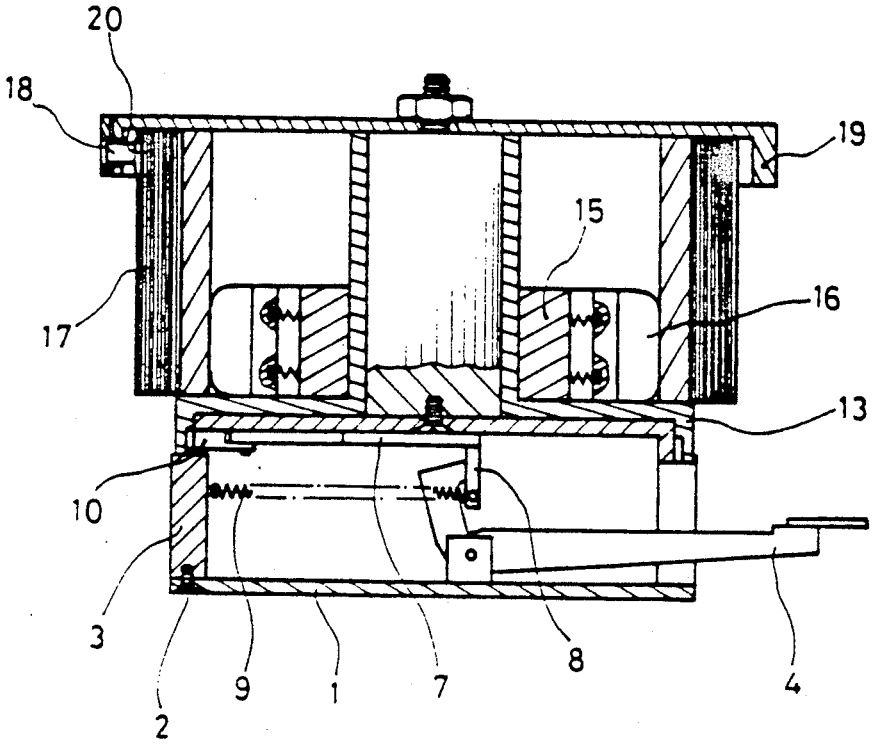
FIG. 3 is a cross-sectional view of FIG. 1 in accordance with the present invention.
Figure 4:
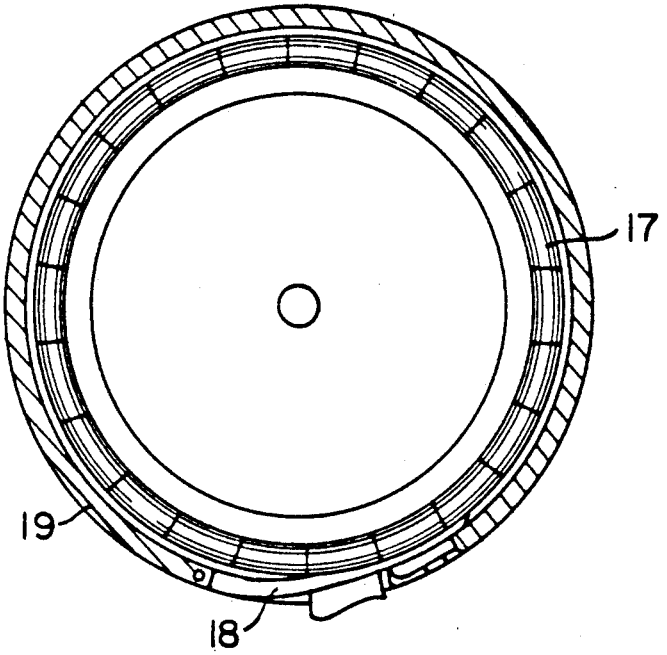
FIG. 4 is a cross-sectional top view of the knife member in accordance with the present invention.
Figure 5:
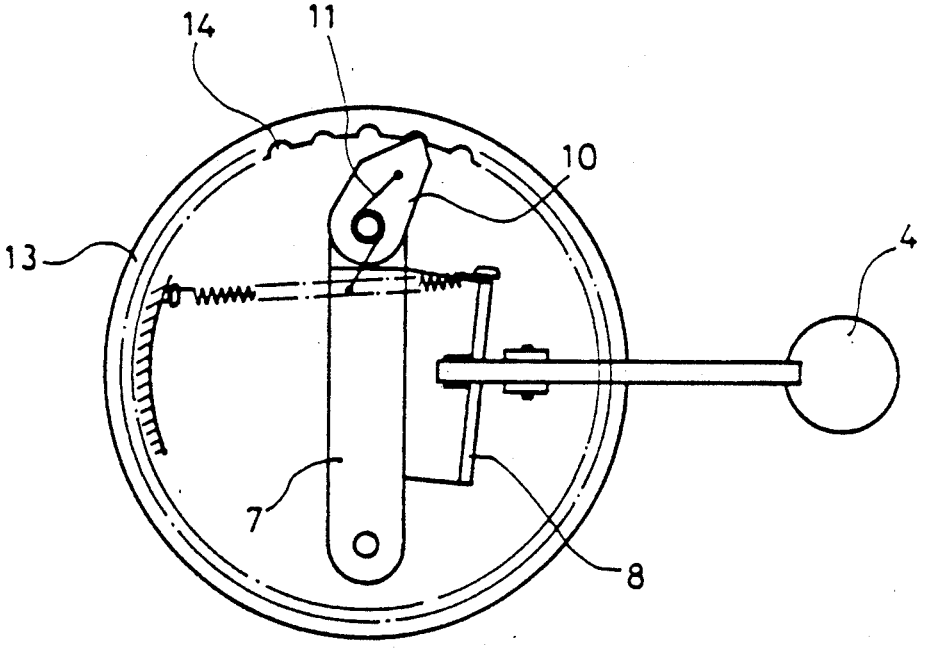
FIG. 5 is a bottom cross-sectional view of FIG. 1 in accordance with the present invention.

Referring to the drawings, the lateral tear tape stand of this invention comprises a base 1 and a lower cover 3 securely fixed on the base 1 by the screws 2. The lower cover 3 is composed of three cylinders with different radius. A L-shaped controlling member 4 is removably disposed on the base 1 by fixing member 5. The longer end of the L-shaped controlling member 4 is outwardly extending through the longitudinal opening 6 of the lower cover 3 for pressing to actuate the present lateral tear tape stand. The shorter end of the L-shaped controlling member 4 is engaged with a pushing plate 8 fixed on a first driving piece 7. A linear spring 9 is provided to keep the distance between the pushing plate 8 and the lower cover 3 constant. The relative angle and position between the first driving piece 7 and the second driving piece 10 is maintained by a torsion spring 11. The front portion of the second driving piece 10 is in a special shape and passes through a lateral opening 12 to removably engage with a serrated inner wall 14 of a cylindrical sheath 13. With the special shape, the movement between the second driving piece 10 and the serrated inner wall 14 is irreversible. The cylindrical sheath 13 is rotatably wrapped on the lower cover 3 and a roller bearing (not shown) is provided between the cylindrical sheath 13 and the lower cover 3 to facilitate the rotation. An annular tape supporting member 15 is mounted on the cylindrical sheath 13 and includes three resilient member 16 disposed on the periphery thereof for providing a secure contact between the annular tape supporting member 15 and the tape 17. A knife 18 is inwardly removable disposed on the vertical edge of a upper cover 19 such that the clearance between the knife 18 and the edge of the upper cover 19 equal to the thickness of a lateral tear tape. The upper cover 19 is fixed on the lower cover 3 by a screw. The unglued upper portion 20 between two tape film of a lateral tear tape 17 suitable used in this invention is continuous to keep the tape 17 in a screwed shape form. Therefore, as the knife 18 being inserted between two tape films, the contineous edge of the tape 17 will form a guiding groove to guide the moving direction of the knife 18.

In use, the longer end of the L-shaped controlling member 4 is pressed down and the shorter end thereof simultaneously pushes the pushing plate 8 moving forwardly to extend the linear spring 9. Since the movement between the second driving piece 10 and the serrated inner wall 14 is irreversible, the movement of the second driving piece 10 will drive the cylindrical sheath 13, the annular tape supporting member 15 and the tape 17 in turn toward the direction which is opposite to the movement of the knife 18. The knife 18 will be inserted into the clearance between the unglued portions of two tape films and the continuous portion of two adjacent tape films will be cut off. The film explosed from the clearance between the knife 18 and the vertical edge of the upper cover 19 can be torn down by user's finger. As the downwardly pressing force applied on the L-shaped controlling member 4 is released, the resilient force of the linear spring 9 will pull the second piece 10 toward the opposite direction. In this moving direction, the engagement between the second piece 10 and the serrated inner wall 14 is changable. Therefore, the second piece 10 slides passing the inner wall 14 and does not drive the cylindrical sheath 13. If the user would like to take another tape film, this purpose could be achieved by pressing the longer end of the L-shaped controlling member 4 again.

Accordingly, it can be seen that the present invention has provided many advantages and improvements. Such as, it can provide a formal size of films for regular use, the use of the tape becomes easier and better than ever before while the films are capable of preventing them from becoming dirty. It is obvious that the present invention has provided a new and useful product for good working.

While the invention has been explained in relation to its preferred embodiment, it is to be understood that various modifications thereof will become apparent to those skilled in the art upon reading this specification. Therefore, it is to be understood that the invention disclosed herein is intended to cover such modifications as fall with the scope of the appended claims.

We claim:

1. A lateral tear tape stand comprising:

a base plate;

a lower cover body closely disposed on said base plate and having a lateral opening and a longtitudinal opening;

a controlling means having one end movably fixed on said base plate and the other end outwardly extending through said longitudinal opening;

a driving means having a first member, a second member and a spring member for rotatably connecting one end of said first member and that of said second member, the other end of said first member rotatably disposed on said lower cover body and that of said second member outwardly extending through said lateral opening;

a pushing means having a laterally elongated pushing plate projecting from said first member and contacting with said controlling means, and a flexible member for connecting said laterally elongated pushing plate with said lower cover body;

a hollow and cylindrical driven means irreversably sheathed on said driving means and having a serrated inner wall for irreversibly and removably engaging with the other end of said second member; and an upper cover having a vertical edge and a knife member inwardly removable disposed on the vertical edge of said upper cover such that the clearance between said knife member and the edge of said cover equal to the thickness of a lateral tear tape.

2. A lateral tear tape stand as claimed in claim 1, further comprising an annular tape supporting means disposed on said hollow and cylindrical means.

3. A lateral tear tape stand as claimed in claim 2, wherein said annular tape supporting means includes three resilient members spaced at equal interval from each other and disposed on said annular tape supporting means.

4. A lateral tear tape stand as claimed in claim 1, wherein said controlled means includes a fixing member disposed on said base plate and a L-shaped member rotatably mounted on said fixing member.

5. A lateral tear tape stand as claimed in claim 4, wherein said L-shaped member includes a shorter portion for connecting with the pushing plate of said pushing means and a longer portion outwardly extending through the longitudinal opening of said cover body.

6. A lateral tear tape stand as claimed in claim 1, wherein said spring member for connecting one end of said first member with that of said second member is a torsion spring.

7. A lateral tear tape stand as claimed in claim 1, wherein said flexible member of said pushing means is a linear spring.

* * * * *